United States Patent [19]

Bergeron, Jr.

[11] 4,067,448

[45] Jan. 10, 1978

[54] LIFT AND SUPPORTING SYSTEM

[75] Inventor: Hervin Joseph Bergeron, Jr., Opelousas, La.

[73] Assignees: Luke Bourgeois; Charles Bourgeois; John G. Bourgeois; Eddie Bourgeois, all of Lawtell, La. ; part interest to each

[21] Appl. No.: 578,911

[22] Filed: May 19, 1975

[51] Int. Cl.[2] ..... B66F 1/08

[52] U.S. Cl. ..... 214/1 H; 52/122; 187/2; 187/8.59; 254/108; 280/766

[58] Field of Search ..... 214/1 H; 52/79, 122, 52/143; 187/2, 8.59; 61/46.5, 90–91; 254/108, 109, 86 H, 86 R; 280/764, 765, 766

[56] References Cited

U.S. PATENT DOCUMENTS

| | | | |
|---|---|---|---|
| 265,560 | 10/1882 | Ball | 214/710 |
| 2,372,705 | 4/1945 | Bicker | 254/86 R |
| 2,540,679 | 2/1951 | Laffaille | 61/46.5 X |
| 2,657,009 | 10/1953 | Neis | 254/93 |
| 2,734,726 | 2/1956 | Gebhart | 280/765 X |
| 2,902,256 | 9/1959 | Gustafsson | 254/106 |
| 2,920,870 | 1/1960 | Suderow | 254/93 |
| 2,930,200 | 3/1960 | Perkins | 61/46.5 |
| 3,347,522 | 10/1967 | Reinmann | 254/105 |
| 3,881,687 | 5/1975 | Johansson | 254/108 X |

*Primary Examiner*—Robert J. Spar
*Assistant Examiner*—George F. Abraham
*Attorney, Agent, or Firm*—John F. Sieberth

[57] ABSTRACT

Systems are described involving (i) a plurality of columns disposed around the object to be lifted, each column having a rack extending longitudinally along one side thereof (ii) means for carrying the object (iii) means keeping the columns upright during lifting and supporting operations (iv) means at the base of the columns to keep them from sinking in the terrain (v) a jacking system on each column and connected to (ii) so that the object can be raised in step-by-step fashion by means of a rack and pawl system and (vi) driving means to operate the jacking systems either in unison or individually as desired. Building modules or the like are raised and held in place by the system while a permanent supporting structure is placed, erected or constructed thereunder.

14 Claims, 15 Drawing Figures

26
25
28
31
10
29
20
10
3
3
30
54
37
56
49
53
43
47
41
39
35
36
44
42
40
48

50
16
34
33
38
12
14

LIFT AND SUPPORTING SYSTEM

This invention relates to a system capable of lifting heavy loads to desired elevations and supporting such loads for long periods of time in the desired position at the desired elevation. More particularly this invention relates to a system which can be (1) readily transported to a building construction site, (2) set up for operation in a short period of time, (3) used to raise and support a load such as a building module or the like in the selected position for whatever length of time it takes to place, erect or construct a permanent supporting structure beneath the load, (4) released from the load so that the load is carried by the permanent supporting structure, and (5) readily disassembled for transport away from the site.

In accordance with this invention the lift and supporting system comprises a lift and supporting system for building structures or the like which comprises (1) a plurality of columns adapted to be positioned in a suitable load-support plan about the structure to be lifted and supported, each column having a rack extending longitudinally along one side thereof, (2) structure carrying means adapted to be placed beneath the structure and to carry the same during the lifting operation, (3) means adapted to maintain said columns in an upright position while the structure is supported on said structure carrying means, (4) means at the base of each said column for distributing the load over an area sufficiently large to restrain the column against undue sinkage into the supporting terrain thereunder while the structure is supported on said structure carrying means, (5) a jacking system adapted to be operatively mounted on each column, each jacking system including (a) a pair of individually moveable members encircling the column, (b) pawl means mounted on each said member, (c) driving means connected to the pair of individually moveable members for effecting selective relative movement therebetween longitudinally along the column; said pawl means cooperating with the rack on said column whereby the pawl means of one of said pair of members is in load-supporting engagement with said rack as the other of said pair of members is being moved in a preselected direction longitudinally along the column by said driving means, one member of each pair of said individually moveable members being operatively connectable to said structure carrying means to enable lifting and supporting of the structure to be effected, and (6) means for selectively actuating each of said driving means so that the structure may be lifted and supported in the desired position. Preferably there are at least four of said columns used in the system.

In a preferred embodiment of this invention the foregoing structure carrying means is a wheeled trailer vehicle having said plurality of columns pivotally mounted thereon in position to be rotated into upright position so that said means at the base of each said column is at essentially normal ground level.

In another preferred embodiment the system which comprises (1) through (6) inclusive as described above, further includes means restraining said columns against undue movement in any lateral direction while the structure is supported on said structure carrying means.

While variations are permissible and within the ambit of this invention, the preferred structure carryings means are either of two types. In one case they are unitary structure, such as a framework of metal rods or a platform or the like, which is adapted to be operatively connected between and among one member of each pair of said individually moveable members associated with said columns arranged in the load support plan. In the other preferred arrangement, the structure carrying means comprise at least two discrete elongated supports one of which is adapted to be operatively connected between one member selected from each of two pairs of said individually moveable members associated with adjacent columns arranged in the load-support plan, and another of which is adapted to be operatively connected between one member selected from each of two pairs of said individually moveable members associated with two other adjacent columns arranged in said plan. When the structure carrying means are in the form of a unitary structure, it is particularly preferred to equip the same with wheels so that the unitary structure can be towed to the construction site. This enables the carrying means to serve not only as the means for carrying the load during the lifting and supporting operations, but as the means for carrying other components of the system to the construction site before these operations are conducted and away from the site after these operations have been conducted. When the structure carrying means are in the form of discrete elongated supports, each such support is preferably constructed such that its length is adjustable. This enables the system to be adjusted to variously-sized load support plans without the need for using different components in the system. Thus the lengths of such adjustable elongated supports and as a consequence the spacing between the columns at either end of these supports can be varied as may be necessary or desirable.

While various types of driving means are feasible for use in the systems of this invention, such as for example manually actuated mechanisms or the like, it is particularly advantageous from the standpoints of safety, controllability and reliability to employ fluid motor means, especially double acting hydraulic fluid motor means for this purpose. Hence in a preferred system having four columns, four double acting hydraulic fluid devices are preferably employed as the driving means, one per column, and selective, controlled actuation of these devices is accomplished and coordinated by control means which can be operated from a suitably located control panel or the like.

In order to eliminate forces tending to cause binding of the individually moveable members when under heavy loads—forces which in severe cases might even tend to cause the columns to buckle—it is desirable to design and arrange the system so that the rack and pawl means associated with each column are positioned on the side of the column essentially opposite the side where the motor means are located. For best results the operative connection between one member of each pair of said individually moveable members and said structure carrying means is effected on the side of each respective column where the motor means are located.

The systems of this invention can be manufactured at relatively low cost, oftentimes at costs substantially lower than mobile cranes or other conventional lifting devices. In addition, it is relatively easy to transport and use the systems of this invention—they can be towed or carried to and from the construction site by any of a variety of suitable vehicles. Set up time for use is short. Moreover, the systems can be employed on or in connection with prepared building sites such as concrete slabs, gravel beds, etc. or with suitable cleared, unprepared sites, such as open grass fields, etc. Undulations and reasonable slopes in the terrain pose little or no problem—the system can be adjusted and operated in such a way as to raise and maintain the load in a horizontal position, where this is desired.

Still another feature of this invention is its safety and reliability. By virtue of interaction among the basic components of the system, a building structure such as a prefabricated second story for a school, office, home, apartment, hospital, church, library, or etc., can be safely and securely raised to the position where it is to remain permanently, and be safely and securely held in this position as the permanent supporting structure—e.g., walls or pillars or even an entire first floor structure—is being erected or set in place thereunder. Once this permanent supporting structure is ready to support the load, the load is released from the lift system of this invention and the system is removed for use or storage elsewhere. It will also be noted that use of the system enables construction work to be done on ground level. For example, carpenters may construct a second story room at ground level, the room may then be raised into position by the lift system and held there as the carpenters continue to work at ground level in constructing a first story room underneath the second story room. Thereafter, when the work has reached the appropriate stage, the lift system is taken away.

These and other aspects, features, advantages, and embodiments of this invention will become still further apparent from a consideration of the ensuing description, the appended claims and the accompanying Drawings in which:

In the foregoing Figures like characters of reference designate like parts.

Figure 1:
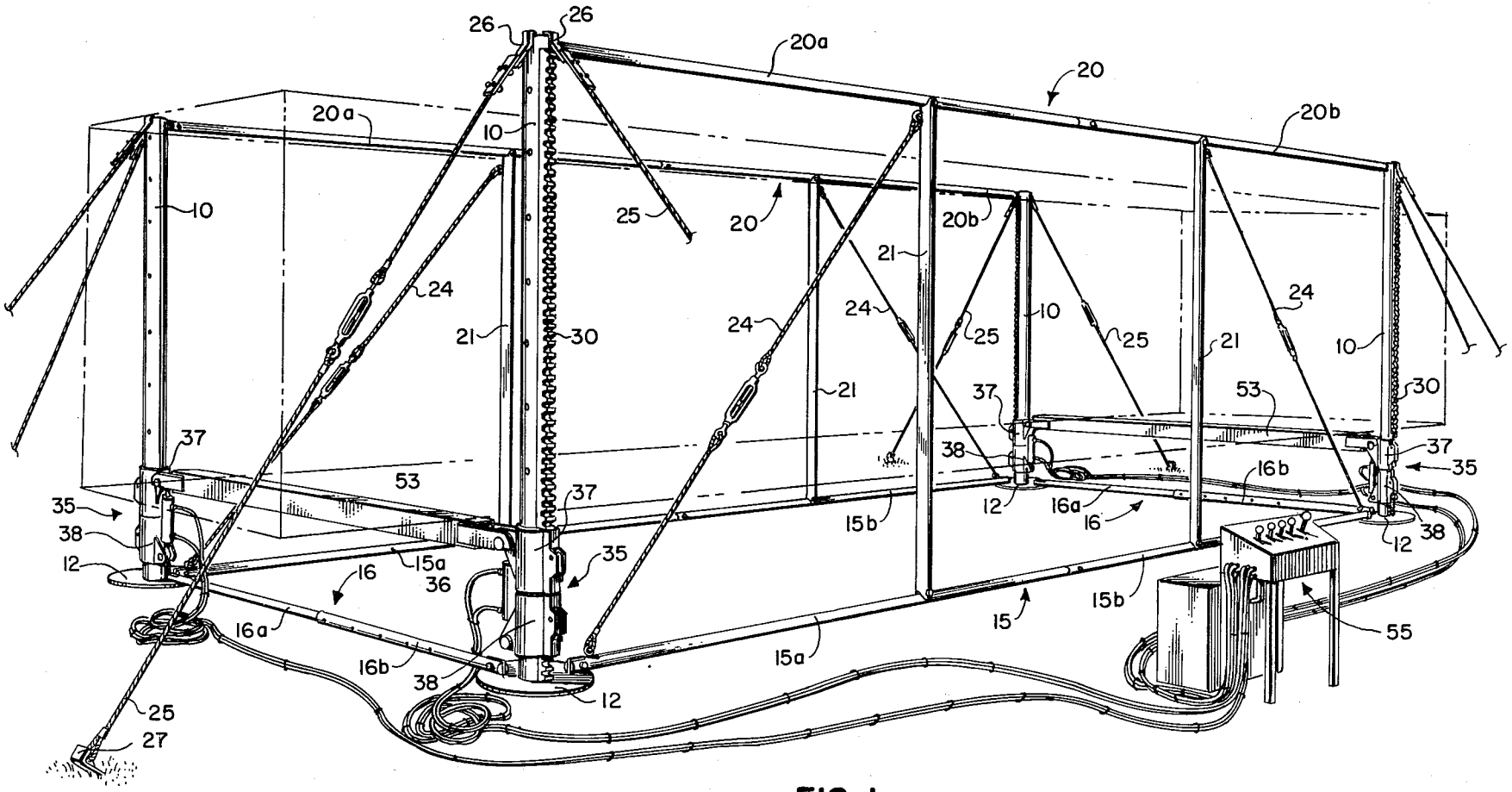
FIG. 1 is an elevation in perspective of a preferred lift and supporting system of this invention in which the structure carrying means are discrete elongated supports.
Figure 4:
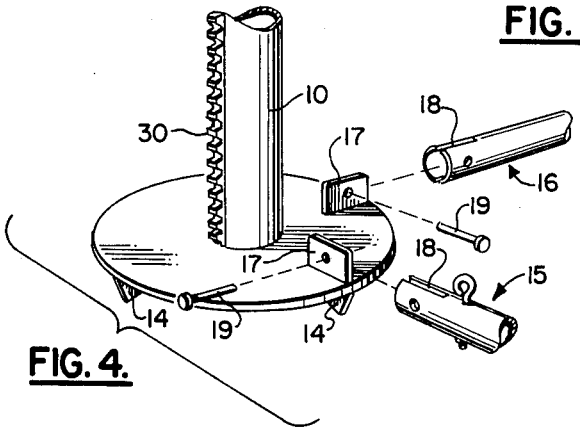
FIG. 4 is a view in perspective of the base portion of a column of FIG. 1 and depicting in exploded fashion connections associated therewith.

Referring more particularly to FIG. 1, the system illustrated therein is composed of four load support columns 10 each of which is connected (permanently or detachably) to and supported on a base plate 12 in a suitable load-support plan about the structure (shown by means of phantom lines) which is to be lifted and supported. The base plates 12 are designed to distribute the load over an area large enough to restrain the columns 10 against undue sinkage into the supporting terrain. As depicted in FIG. 4 each base plate is preferably equipped on its underside with a plurality of cleats 14 to assist in anchoring the base plate to the terrain so that the base plate will not move to any significant extent when the load is applied. From FIG. 2 it will be seen that cuff 33 welded or otherwise united to base plate 12 and having an outer diameter sized to slidably fit into the lower end of column 10 is a convenient way of effecting the connection between column 10 and base plate 12. Where this connection is a detachable connection, a bolt (not shown) may be passed through hole 34 so as to extend from one side to the other when the column is properly oriented on cuff 33 (holes 34 in the cuff and in the column being aligned when proper orientation of the column is achieved) and secured in place by a nut (not shown).

From FIGS. 1 and 4 it can be seen that in the system illustrated therein, each base plate 12 is connected to each of two adjacent base plates by means of rods 15 and 16, rods 15 being depicted generally as elongate members each composed of two segments **15*a*, 15*b* of equal diameter detachably connectable to each other (note FIG. 6), and rods 16 each being depicted generally as composed of two concentric tubular members 16*a*, 16*b*, one of which (16*a*) is slidably received within the bore of the other (16*b*) to permit the length of rods 16 to be adjusted. Nuts and bolts or other suitable fastening means (not shown in detail) are utilized in conjunction with appropriately positioned holes extending transversely through both of the concentric members 16*a*, 16*b* of each rod 16 to retain it in its desired length. A similar mode of attachment is shown in FIG. 4 for detachably attaching the ends of rods 15 and 16 to base plate 12. More specifically, the upper surface of plate 12 is provided with a pair of upstanding apertured plates 17 welded or otherwise fastened thereon so that their planes are at right angles to each other. At each outer end of each rod 15 and each rod 16 there is a vertical slot 18 sized to slidably recieve an apertured plate 17 and, as illustrated, a bolt 19 is passed through holes extending through the lateral portions of the rod adjacent slot 18 and through the aperture in plate 17** and held in place by means of a nut (not shown).

Figure 6:
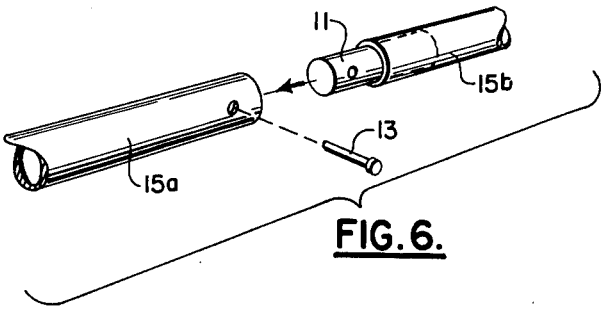
FIG. 6 is a view in perspective of segments of connectable members extending from the base portion of one column to the base portion of another column of the system of FIG. 1 and depicting in exploded fashion the manner by which these members may be connected together.

Referring again primarily to FIG. 1 the system depicted includes a pair of rods 20 extending between and serving to detachably connect the upper portions of adjacent columns 10. Rods 20 may be thought of as elevated counterparts of rods 15. Thus in the form depicted, a pair of adjacent columns 10, one rod 15 and one rod 20 taken together essentially define a rectangular frame. As in the case of rod 15, each rod 20 is depicted generally as an elongate member composed of two segments 20*a*, 20*b* of equal diameter detachably connectable to each other using, for example, the same kind of connection arrangement as is shown in FIG. 6 for making corresponding connections in rods 15. As is readily apparent from FIG. 6, this connection involves tightly fastening shaft 11 within the bore of one of the segments to be connected (shown as 15*b* in FIG. 6) so that a suitable length of shaft 11 protrudes from the end of that segment and can be slidably received within the bore of the other segment. A bolt or pin 13 is passed through a hole which extends through the latter segment (shown as 15*a* in FIG. 6) and the portion of shaft 11 slidably received therein, and a nut or other suitable fastener (not shown) is applied to hold bolt or pin 13 in place thereby preventing the two segments (shown as 15*a*, 15*b* in FIG. 6) from coming apart. It is desirable to utilize segmented rods 15 and 20 as this keeps the length of the individual segments 15*a*, 15*b*, 20*a*, 20*b* within reasonable limits so they are not difficult or unwieldy to carry and handle either in transport or in the field.

Figure 5:
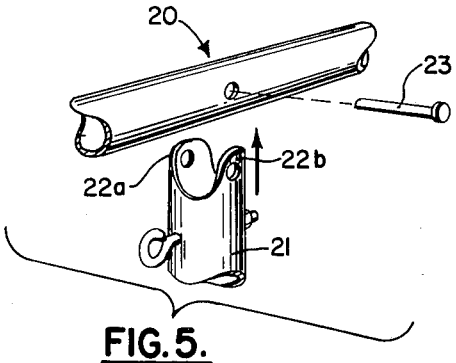
FIG. 5 is a view in perspective of segments of support members of the system of FIG. 1 and depicting in exploded fashion the manner by which these members may be connected together.

As seen in FIG. 1, brace members 21 are detachably attached at each end to and extend vertically between rods 15 and 20. FIG. 5 illustrates a preferred mode of attachment for this purpose, the attachment as shown involving a connection between the top of a brace member 21 and rod 20 supported thereon. It will be readily appreciated however that the same general arrangement is suited for effecting a connection between the bottom of a brace member 21 and rod 15, rod 15 being placed underneath the lower end of brace member 21 but otherwise the connection being made in the same manner. In particular, as shown in FIG. 5, at least the end portions (in this case, the upper end portion) of brace member 21 are of larger diameter than the diameter of the rod (in this case, rod 20) to which it is to be connected. The end portion is cut away or recessed to receive the rod between opposed apertured upstanding flanges 22*a*, 22*b*. Fastener 23 such as a pin (as shown) or a bolt is passed through the apertures in flanges 22*a* and 22*b* and through a suitably placed aperture in the rod, and the connection made fast by means of a cotter pin, nut or other suitable retainer (not shown).

Figures 2, 11:
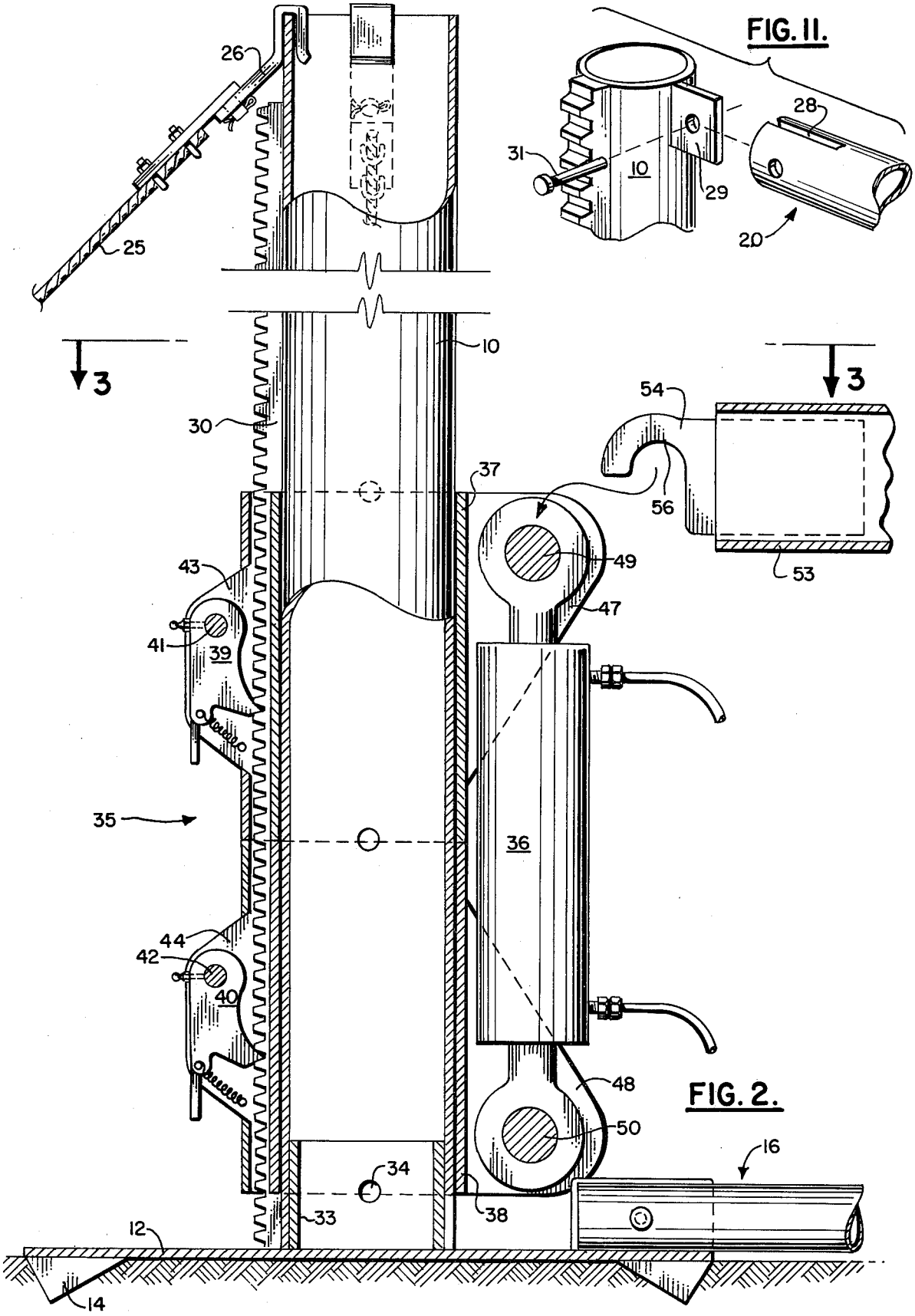
FIG. 2 is an elevation, partly in section, of one of the columns of the system of FIG. 1 and showing in greater detail, inter alia, a rack extending longitudinally along one side of the column and a jacking system cooperatively associated therewith, a portion of the column being taken to signify indeterminate height.
FIG. 11 is an elevation in perspective illustrating in exploded fashion the manner by which a bracing rod may be connected to the upper portion of the columns of FIG. 1.

FIG. 11 illustrates the manner by which rod 20 may be fastened to the upper portion of column 10. At each outer end of rod 20 there is a vertical slot 28 sized to slidably recieve apertured plate 29 welded or otherwise tightly fastened to the upper portion of column 10 and extending in a vertical plan in the direction toward the adjacent column 20 (not shown in FIG. 11) to be connected to rod 20 at its other end in the same manner. Bolt 31 or other suitable fastening means is passed through holes extending through the lateral portions of the rod adjacent slot 28 as well as through the aperture in plate 29 and fastened in place by means of a nut or other suitable fastener (not shown).

Figure 9:
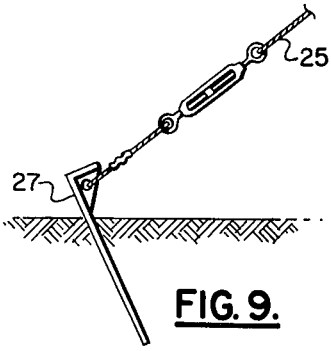
FIG. 9 depicts in side view a means for anchoring to the ground a system such as illustrated in FIG. 1 or in FIG. 11.

As shown in FIG. 1, adjustable brace members 24 are suitably positioned diagonally between the upright braces 21 and rod 15 and tightened so that the entire framework may properly function to lift and support the load. As shown in FIGS. 1, 2 and 9, guy lines 25 made of cable or the like are suitably attached by means of clamps 26 to the top of each column 10 and to stakes 27 driven into the ground at suitable locations. Upon taking up any slack in guy lines 25 the entire system is firmly anchored in place.

Figure 3:
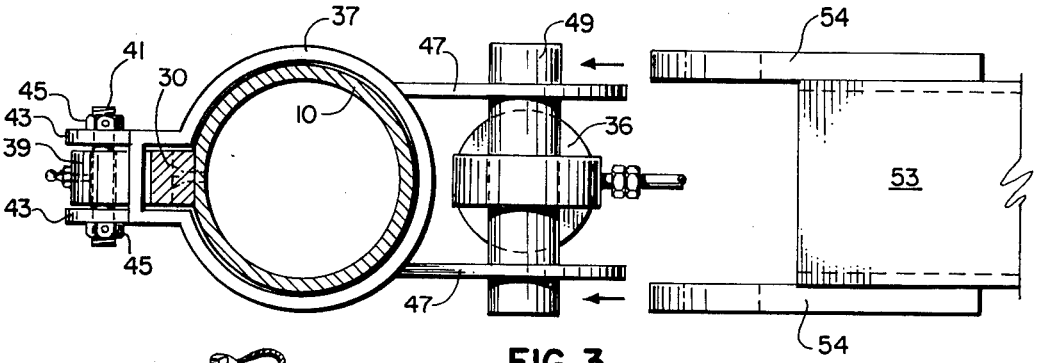
FIG. 3 is a plan view taken along line 3—3 of FIG. 2.

From FIGS. 1, 2, 10A, 10B and 10C it will be seen that each column 10 has affixed thereto a rack 30 which extends longitudinally along one side thereof, rack 30 being positioned along that side of column 10 which is furthest away from the load. The teeth of rack 30 are relatively closely spaced for reasons which will become readily apparent as the description proceeds. Mounted on each column 10 is a jacking system designated generally by the numeral 35 composed of a pair of collars 37, 38 encircling column 10 and its rack 30 (note FIG. 3), pivoted pawl means 39, 40 positioned to work in conjunction with rack 30 (note FIGS. 10A, 10B and 10C) and a double acting hydraulic fluid motor mechanism 36. Pawl means 39 and 40 are pivotally supported near their upper ends on horizontal shafts 41 and 42, respectively, each of which in turn extends between and is supported by a pair of plates 43, 43 and 44, 44 respectively. Plates 43, 43 are attached to or are formed as an integral part of collar 37 and plates 44, 44 are attached to or formed as an integral part of collar 38. These plates all lie in vertical planes which extend on either side of the edges of rack 30 (note FIG. 3). Thus for example plates 43, 43 are apertured so that pawl means 39 is pivotally supported between them by means of shaft 41 which passes through horizontally aligned apertures in plates 43, 43, shaft 41 being threaded at each end so that it is held in place by a pair of locking nuts 45, 45, all as is illustrated in FIG. 3. The same kind of arrangement is utilized with reference to pawl means 40, i.e., it is pivotally supported between plates 44, 44 on collar 38 by means of shaft 42 which is threaded at each end, passes through horizontally aligned apertures in plates 44, 44 and is secured in place by a pair of locking nuts.

Extending in vertical planes from the side of collar 37 opposite pawl means 39 is a pair of spaced plates 47, 47 which may be integrally formed therewith or welded or otherwise firmly bonded thereto. Shaft 49 extends between and protrudes at each end beyond a pair of horizontally aligned apertures in plates 47, 47 and is journaled or otherwise fastened so that at all times during a lifting and supporting operation, it will remain in the position shown in FIG. 3.

Similarly, from the side of collar 38 opposite pawl means 40 a pair of spaced plates 48, 48 extend in the same general vertical planes as plates 47, 47. Shaft 50 extends between and protrudes at each end beyond a pair of horizontally aligned apertures in plates 48, 48 and is fastened in place in the same way as shaft 49. As indicated in FIGS. 2 and 10A, 10B and 10C, shafts 49 and 50 serve as the mounting means for double acting hydraulic fluid motor mechanism 36, the details of which need not be described since such devices are conventional and well known to those skilled in the art. Suffice it to say that fluid under pressure can be directed to the desired side of piston 52 while at the same time causing fluid to be withdrawn from the opposite side of piston 52, these flows being effected by means of fluid lines, pumps and other associated equipment. As is clear from FIG. 1, in the system depicted all four fluid motor mechanisms may be operated either in unison or individually, as may be desired, from a remote control panel indicated generally as 55.

Figure 7:
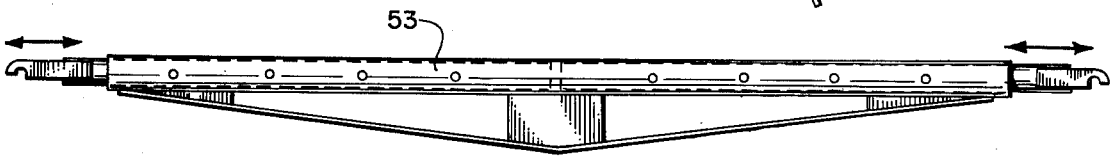
FIG. 7 is a side elevation of a reinforced elongated support member of adjustable length which may be utilized in the system of FIG. 1 in lieu of either or both of the discrete elongated support members depicted therein.
Figure 8:
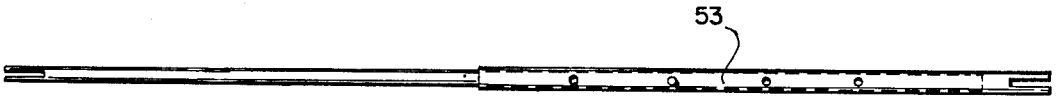
FIG. 8 is a plan view of another type of elongated support member of adjustable length which may be utilized in the system of FIG. 1 in lieu of either or both of the discrete elongated support members depicted therein.

In the system as depicted in FIG. 1 a load support member 53 extends between the two collars 37 along one side of the system and another load support member 53 extends between the two collars 37 along the other side of the system. Each member 53 is detachably attached at each end to the proximate collar 37 in the manner shown in FIGS. 2 and 3. More particularly, a pair of aligned curved hook members 54 are fastened to either side of support member 53 so as to project beyond one end thereof and another pair of aligned curved hook members 54 are fastened to either side of support member 53 so as to project beyond the other end thereof. Each such hook member 54 has a downwardly curved semicircular portion 56 sized and adapted to fit over shaft 49. The lateral spacing between the two proximate hook members 54 at each respective end is sufficient to permit the downwardly curved portion 56 to fit over the respective ends of shaft 49 just outside of the respective plates 47. As a consequence of this construction, hook members 54 securely fit over and are supported on shaft 49 in such a way that they cannot slip off or otherwise become disengaged except by being lifted upwardly relative to shaft 49. It will also be seen that these constructional features result in the lifting force of motor mechanism 36 being transmitted in a vertical direction directly to shaft 49 and to hook members 54 resting thereon so that the load resting on load-support members 53 can be raised and held in elevated position without encountering rotational forces tending to cause binding of collar 37 against column 10. In short, the upward force from the motor means is exerted directly under the ends of the structure carrying means supporting the load. As can be seen from FIG. 7 the load support members 53 may possess additional bracing for added strength. FIGS. 7 and 8 also illustrate the fact that the load support members may be constructed so that they have adjustable lengths.

It will be apparent from the foregoing that the system depicted in FIG. 1 can be readily assembled on the job site. For example, the building unit to be raised may be brought to the desired location and temporarily supported, say, two or three feet above ground level. Base plates 12 are placed at suitable load-distributing locations to the front and rear of the building unit. Rods 15 are assembled by connecting segments 15*a* and 15*b* and rods 15 are in turn connected to base plates 12 as described above. Likewise segments 16*a* and 16*b* are connected to form rods 16 which are in turn connected to base plates 12. The four plates 12 are then tamped into the ground to sink cleats 14, care being taken to see that each plate 12 is level—the level plates 12 need not be in the same horizontal plane, however, since the system performs very well on uneven or sloped terrain where the level plates 12 are in a plurality of different horizontal planes. It will be evident that at this point the four plates 12 have been joined together by a square or rectangular frame composed of two rods 15 (front and back) and two rods 16 (two sides). The two sides (rods 15) will normally pass underneath the unit to be raised. In order that rods 15 and 16 may be kept straight, the terrain is trenched thereunder wherever necessary. Next, each column 10 is placed in horizontal position with its bottom end resting on its plates 12 and the jacking system 35 is slipped over this bottom end so that pawls 39 and 40 are free to engage rack 30. Segments 20*a* and 20*b* are connected to form rods 20 of proper length and a rod 20 is connected to the top ends of the front pair of columns 10 and another rod 20 is connected to the top ends of the rear pair of columns 10, these connections being made while columns 10 are still resting on the ground. The upper end of each of four brace members 21 is fastened to a rod 20, two members 21 being fastened to the rod 20 connecting the front pair of columns 10 and the other two members 21 being fastened to rod 20 connecting the rear pair of columns 10. These connections are likewise made while columns 10 are still resting on the ground. Thereupon the front frame and the rear frames are raised by setting columns 10 onto their respective base plates 12 in a vertical position over cuffs 33, columns 10 being turned or oriented and fastened in place so that rack 30 is in each case facing away from the unit to be raised (note FIG. 1) and the connections between the bottom ends of brace members 21 and rod 15 are effected. Stakes 27 are driven into the terrain at suitable locations and guy lines 25 are fastened to the tops of columns 10 by means of clamps 26 and are fastened to the stakes 27. Use of a turnbuckle or the like enables guy lines to be rendered taut so that the respective frames (front and rear) are rigid. Adjustable brace members 24 are set in place and tightened for additional strength and rigidity. The load support members 53 are placed on shafts 49 as above described so as to extend under the temporarily supported building unit to be lifted. The hydraulic fluid connections are secured and with the framework suitably assembled and secured in place, the fluid motors are actuated so that the load support members are raised into position to lift the building unit upwardly off of its temporary support. In this way the building unit can then be raised safely and evenly to its desired elevated position and locked in place while a suitable foundation or the like is placed or built thereunder. To remove the system after the job has been completed the pawl means 39 and 40 are manually released from their locked positions in rack 30 and the parts are disassembled in roughly the reverse sequence from their assembly.

Figure 10C:
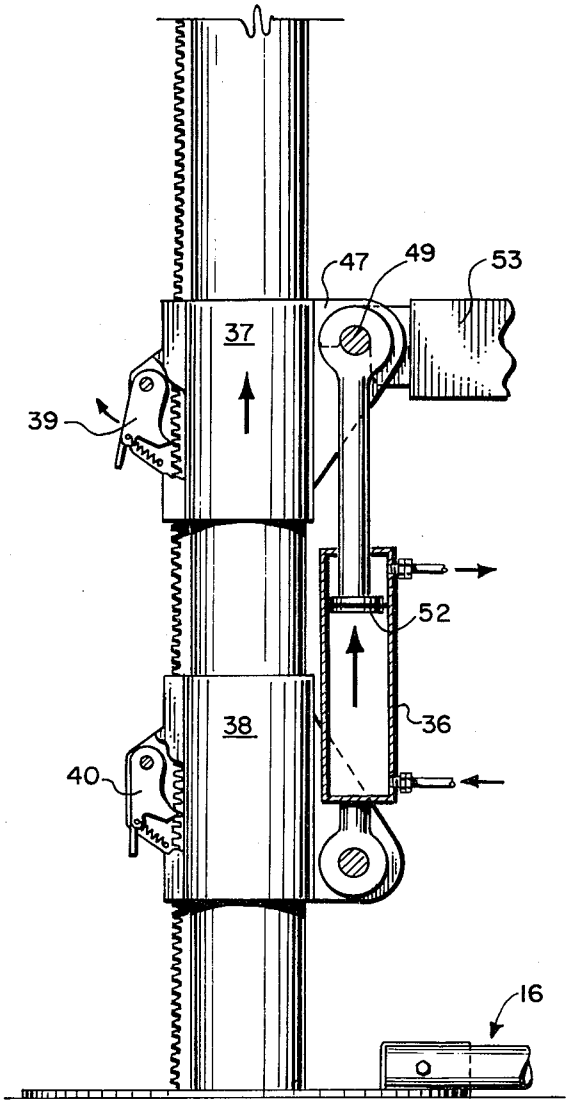
FIGS. 10A, 10B and 10C are side views, partly in section, of a jacking system of FIG. 1 illustrating the progressive, step-by-step manner in which a jacking system functions in ascending a rack on a column.
Figure 10B:
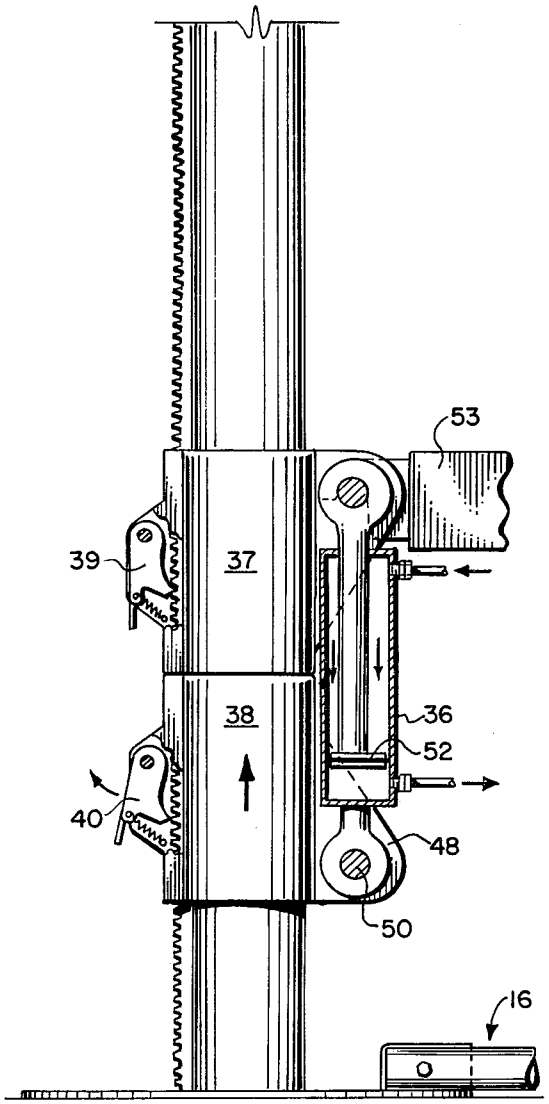
Figure 10A:
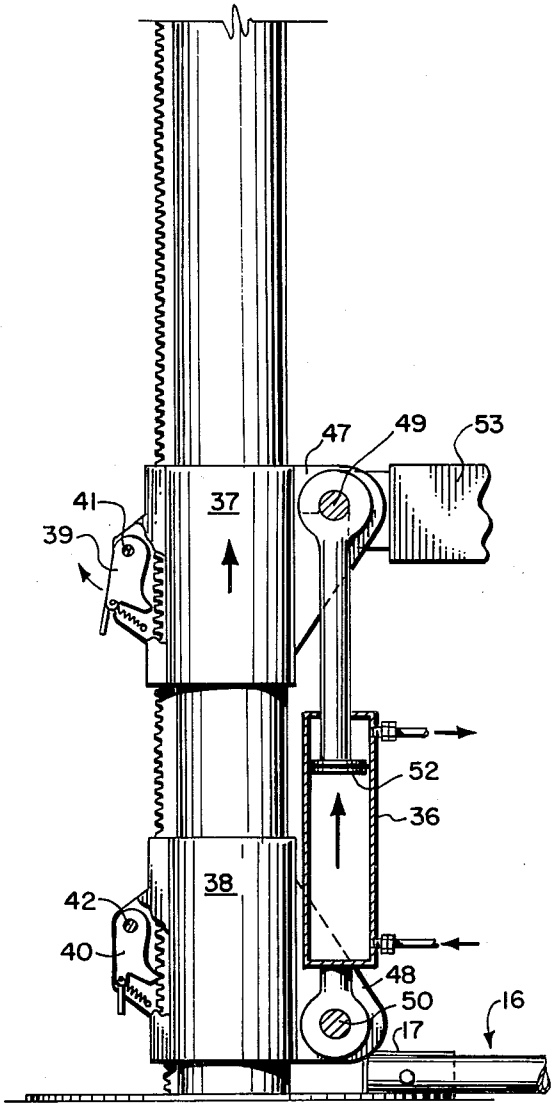

FIGS. 10A, 10B and 10C make clear that during the lifting operation there is a stepwise sequence by which collars 37 and 38 are caused to climb column 10. From an initial position (not shown) where collar 37 rests on top of collar 38, fluid is forced into the chamber of motor mechanism 36 below piston 52 which is forced upwardly in the direction of the vertical arrow in FIG. 10A. Since pawl means 40 of lower collar 38 is under load and thus tightly engaged on rack 30 this upward force of the hydraulic fluid on piston 52 results in upper collar 37 being raised to the position shown in FIG. 10A, pawl means 39 being free to ride upwardly over the teeth in rack 30 since in this phase of the operation pawl means 39 is not under downwardly directed tension. On reaching the position of FIG. 10A the flows of the hydraulic fluid are reversed to those shown by the horizontal arrows of FIG. 10B so that the fluid pressure is exerted above piston 52 whereby pawl means 39 is placed under downwardly directed tension from the load. Thus as soon as pawl means 39 securely engages itself into the spacing between the teeth of rack 30 pawl means 39 remains under tension and holds the load in fixed position. At the same time the tension is released from pawl means 40 and thus collar 38 is drawn upwardly in the direction of the vertical arrow of FIG. 10B until the closed position shown therein is reached.

Thereupon the procedure is repeated whereby pawl means 40 is again placed under tension on rack 30 and pawl means 39 being released from tension is free to ride upwardly with collar 37 by virtue of the upward force on piston 52 from the flow of hydraulic fluid directed in manner of the horizontal arrows of FIG. 10C. It will thus be clear that by alternating the flow of the hydraulic fluid to opposite sides of the piston of the hydraulic fluid motor mechanism the load can be safely and securely raised along the columns. It will also be seen that at all times one or the other of pawl means 39 and 40 is under tension and as a consequence is firmly locked or secured in place on rack 30. Only when one of pawl means 39 and 40 is so locked in place is the other pawl means relieved of its tension and free to move upwardly. Thus the load carried by the jacking system 35 is at all times under direct mechanical support on rack 30, even with the hydraulic fluid turned off.

For best results the teeth on rack 30 should be closely spaced as this enables small adjustments to be made in the elevations of individual jacking systems 35 as may be necessary or desirable to maintain the load in horizontal position when effecting the operation on uneven terrain. Thus the spacing between respective teeth on rack 30 is preferably between about 2.5 and about 5.0 centimeters. The upper surface of each tooth is preferably downwardly inclined by no more than about 10° to 15° from horizontal as this furnishes a contact angle between the pawl and the tooth that is secure and free from the likelihood of slippage.

Figure 13:
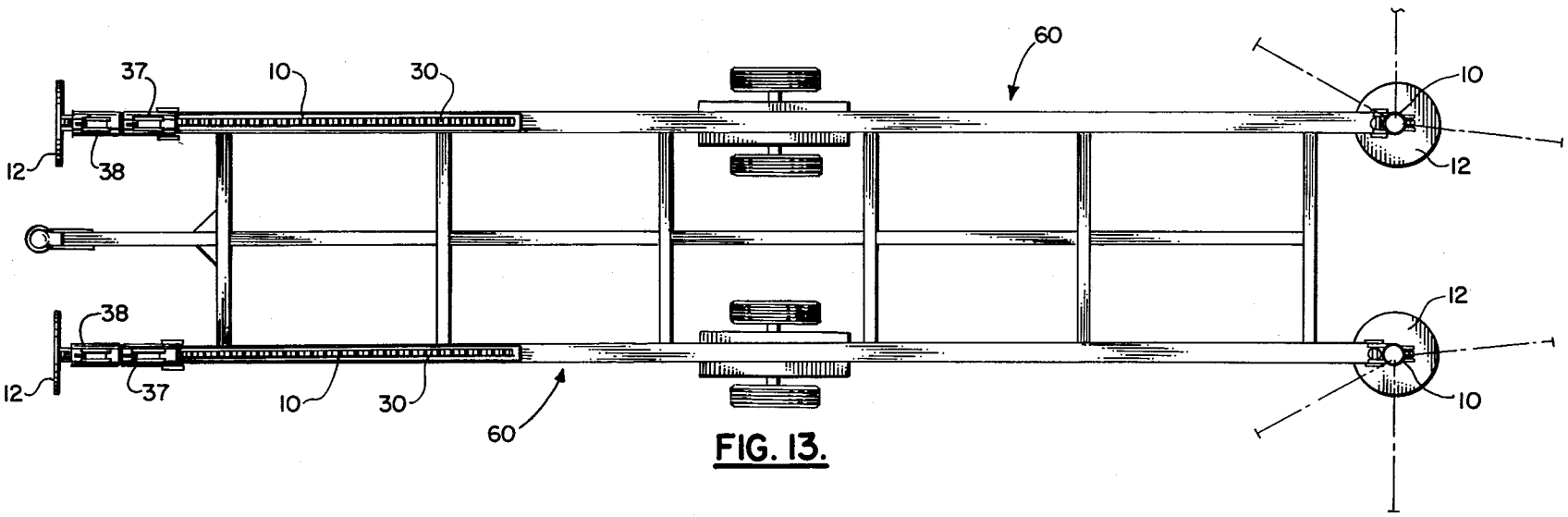
FIG. 13 is a plan view of the system of FIG. 12.
Figure 12:
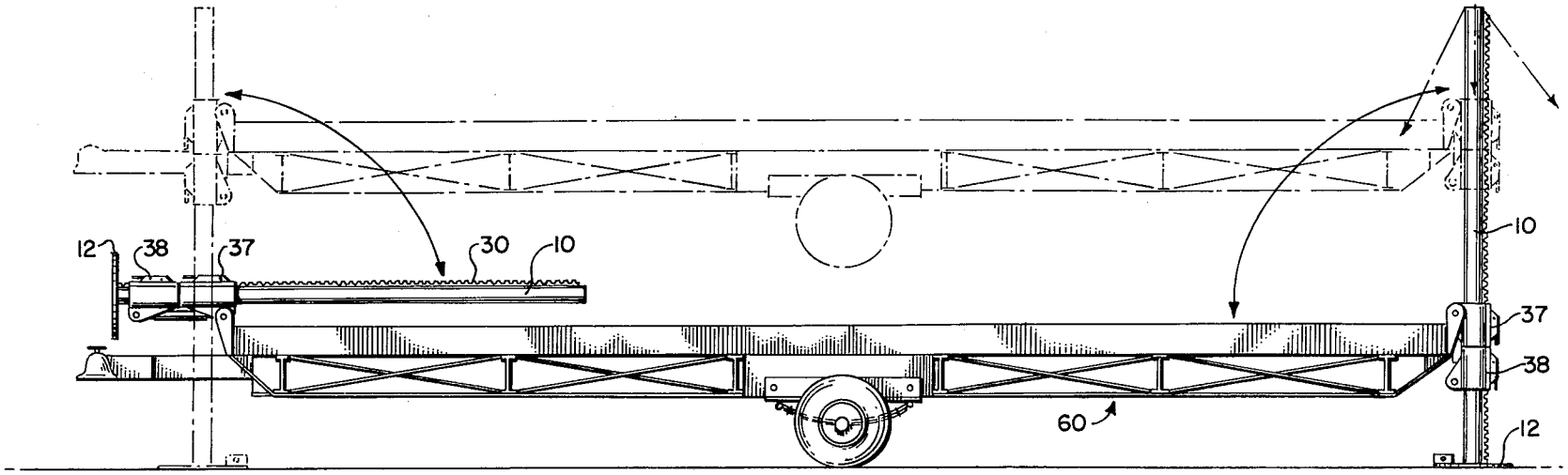
FIG. 12 is a side elevation of an alternative preferred unitary lift and supporting system of this invention which is equipped with wheels facilitating transport of the system to and from the work site and which is provided with hinged columns facilitating the set up and break down operations before and after use, respectively.

The preferred system depicted in FIGS. 12 and 13 functions in the same way as that just described with reference to FIG. 1. It possesses the additional advantages however of not requiring the assembly of as many parts on the job site, of being wheeled and thus readily transported to and from the work site, and of being adapted to serve as a trailer to carry the building module or the like to the place where it is to be installed as well as the serving as the system for lifting and supporting the module or the like at the construction site. As these Figures indicate the columns 10 are pivotally supported on a rigid horizontal frame indicated generally by the numeral 60 which serves as a trailer bed and as the load support member. As FIG. 12 indicates, once the system has been placed in position at the job site, the four columns 10 are pivoted into upright position. On level terrain base plates 12 (which may be cleated on their under surfaces) will be at essentially ground level when the columns are pivoted or rotated into upright position. If the terrain is uneven, the terrain may be trenched or filled or shims or other supports may be placed under base plates 12 to the extent necessary. Clamps or braces (not shown) may be affixed to the upright columns to lock them in upright position. Thereupon the guy wire systems involving for example use of stakes and clamps as described above are put in place and tightened so that the system is secured in place. If desired the wheels may be blocked to further secure the system in place. Then the hydraulic system is connected to the respective jacking systems and the system is ready for use in raising the load in the manner discussed above. The phantom view of FIG. 12 depicts the system raised from its initial position.

From the foregoing, it will be seen that this invention is one well adapted to attain all of the ends and objectives hereinabove set forth together with other advantages which will now be obvious to those skilled in the art and which are inherent in the invention as depicted, described or claimed, or in its tangible manifestations.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense. Without limiting the generality of the foregoing, it will be understood and appreciated that the various parts of the embodiments described above, their modes of connection and their respective configurations are susceptible to considerable variation. For example, rack 30 may be in the form of a pin gear rack, a rack of link chain, or like structures instead of having the gear tooth-type configuration herein depicted. Similarly the pawl means 39, 40 can be of various suitable configurations so long as they perform the specified functions. These and a myriad of other variations will not be clearly apparent to those skilled in the art.

It will also be understood and appreciated that the foregoing specific embodiments of this invention have been shown and described for the purpose of illustrating the principles and practice of this invention and that the foregoing specific embodiments are subject to extensive change or modification without departure from such principles and practice. Consequently this invention is intended to include all modifications legitimately encompassed within the spirit and scope of the ensuing claims and the bona fide equivalents thereof.

I claim:

1. A lift and supporting system for building structures or the like which comprises:

1. a plurality of columns adapted to be positioned in a suitable load-support plan about the structure to be lifted and supported, each column having a rack extending longitudinally along one side thereof;
2. structure carrying means adapted to be placed beneath the structure and to carry the same during the lifting operation;
3. guy means extendable downwardly and outwardly from the upper portions of the individual columns and adapted to maintain said columns in an upright position while the structure is supported on said structure carrying means;
4. base plate means at the base of each said column for distributing the load over an area sufficiently large to restrain the column against undue sinkage into the supporting terrain thereunder while the structure is supported on said structure carrying means;
5. a plurality of elongated members operatively connectable to extend between adjacent columns in the load-support plan thereby to form a frame restraining said columns against undue movement in any lateral direction while the structure is supported on said structure carrying means;
6. a jacking system adapted to be operatively mounted on each column, each jacking system including
   a. a pair of individually moveable members encircling the column
   b. pawl means mounted on each said member
   c. double acting hydraulic fluid motor means connected to the pair of individually moveable members for effecting selective relative movement therebetween longitudinally along the column said pawl means cooperating with the rack on said column whereby the pawl means of one of said pair of members is in load-supporting engagement with said rack as the other of said pair of members is being moved in a preselected direction longitudinally along the column by said motor means, one member of each pair of said individually moveable members being operatively connectable to said structure carrying means to enable lifting and supporting of the structure to be effected; and 7. control means for selectively actuating each of said motor means so that the structure may be lifted and supported in the desired position.

2. A lift and supporting system in accordance with claim 1 wherein there are at least four said columns and said structure carrying means comprise at least two discrete elongated supports one of which supports is adapted to be operatively connected between one member selected from each of two pairs of said individually moveable members associated with adjacent columns arranged in the load-support plan, and the other of which supports is adapted to be operatively connected between one member selected from each of two pairs of said individually moveable members associated with two other adjacent columns arranged in said plan.

3. A lift and supporting system in accordance with claim 1 wherein there are at least four said columns and said structure carrying means comprise a unitary structure adapted to be operatively connected between and among one member of each pair of said individually moveable members associated with said columns arranged in the load support plan.

4. A lift and supporting system in accordance with claim 1 wherein the rack and pawl means associated with each column are positioned on the side of the column essentially opposite the side where the motor means are located.

5. A lift and supporting system in accordance with claim 1 wherein the rack and pawl means associated with each column are positioned on the side of the column essentially opposite the side where the motor means are located and wherein the operative connection between one member of each pair of said individually moveable members and said structure carrying means is effected on the side of each respective column where the motor means are located.

6. A lift and supporting system in accordance with claim 1 wherein said elongated members include elongated members detachably attachable to said base plate means.

7. A lift and supporting system in accordance with claim 1 wherein some of said elongated members are operatively connectable to extend between the upper portions of adjacent columns in the load-support plan and other of said elongated members are operatively connectable to extend between the lower portions of adjacent columns in the load-support plan.

8. A lift and supporting system in accordance with claim 1 wherein at least some of said elongated members have adjustable lengths.

9. A lift and supporting system in accordance with claim 1 wherein said elongated members include (i) elongated members of adjustable length detachably attachable to said base plate means and (ii) elongated members of adjustable length detachably attachable to the upper portions of said columns.

10. A lift and supporting system in accordance with claim 9 further including bracing means extending between those elongated members of (i) and those elongated members of (ii) which are in superposed position relative to each other.

11. A lift and supporting system in accordance with claim 1 wherein said base plate means are detachably attachable to the base of their respective columns and said guy means are detachably attachable to the upper portion of their respective columns.

12. A lift and supporting system in accordance with claim 1 wherein the rack and pawl means associated with each column are positioned on the side of the column essentially opposite the side where the motor means are located; wherein the operative connection between one member of each pair of said individually moveable members and said structure carrying means is effected on the side of each respective column where the motor means are located; wherein said elongated members include (i) elongated members of adjustable length operatively connectable to extend between the upper portions of adjacent columns in the load-support plan and (ii) elongated members of adjustable length operatively connectable to extend between the lower portions of adjacent columns in the load-support plan so that a least some of said elongated members of (i) and of (ii) are in superposed position relative to each other; wherein said system further includes bracing means extending between those elongated members of (i) and those elongated members of (ii) which are in superposed position relative to each other; and wherein said base plate means include cleat means extendable into the supporting terrain.

13. A lift and supporting system for building structures or the like which comprises:

1. a plurality of columns adapted to be positioned in a suitable load-support plan about the structure to be lifted and supported, each column having a rack extending longitudinally along one side thereof;
2. means at the base of each said column for distributing the load over an area sufficiently large to restrain the column against undue sinkage into the supporting terrain thereunder while under load;
3. a wheeled trailer vehicle carrying said columns, said vehicle including a load supporting surface adapted to carry the structure, said plurality of columns being pivotally mounted on said vehicle in a suitable load-support plan, each such column being positioned to be rotated into upright position around an axis positioned in a vertical plane outside the adjacent outer periphery of said surface so that said means at the base of each said column can be positioned at essentially normal ground level and each said column when in said upright position extends upwardly adjacent the outer periphery of said surface;
4. means adapted to maintain said columns in an upright position while the structure is supported above the supporting terrain on said trailer vehicle;
5. a jacking system operatively mounted on each column, each jacking system including
   a. a pair of individually moveable members encircling the column
   b. pawl means mounted on each said member c. driving means connected to the pair of individually moveable members for effecting selective relative movement therebetween longitudinally along the column, said pawl means cooperating with the rack on said column whereby the pawl means of one of said pair of members is in load-supporting engagement with said rack as the other of said pair of members is being moved in a preselected direction longitudinally along the column by said driving means, one member of each pair of said individually moveable members being operatively and pivotally connected to said trailer vehicle thereby a. furnishing the pivotal mounting and enabling the rotation referred to in sub-paragraph (3) of this claim, and b. enabling the lifting and supporting of the trailer vehicle and the structure carried thereon to be effected; and 6. means for selectively actuating each of said driving means so that the trailer vehicle and the structure carried thereon may be lifted and supported in the desired position.

14. A lift and supporting system in accordance with claim 13 wherein said means adapted to maintain said columns in an upright position include guy means extendable downwardly and outwardly from the upper portions of the individual columns in upright position.

* * * * *